US005462778A

United States Patent [19]

Ishikawa

[11] Patent Number: 5,462,778

[45] Date of Patent: Oct. 31, 1995

[54] ARTIFICIAL TURF, PILE YARN FOR ARTIFICIAL TURF AND PROCESS AND SPINNERET FOR PRODUCING PILE YARN

[75] Inventor: Yoshio Ishikawa, Kishiwada, Japan

[73] Assignee: Otsuka Kagaku Kabushiki Kaisha, Japan

[21] Appl. No.: 67,492

[22] Filed: May 13, 1993

Related U.S. Application Data

[63] Continuation of Ser. No. 651,249, filed as PCT/JP90/00756, Jun. 8, 1990, abandoned.

[30] Foreign Application Priority Data

Jun. 9, 1989 [JP] Japan ..... 1-147084
Dec. 4, 1989 [JP] Japan ..... 1-315111

[51] Int. Cl.[6] ..... A01N 3/00; B32B 3/02; B28B 5/00

[52] U.S. Cl. ..... 428/17; 428/92; 428/222; 428/371; 428/397; 425/72.2; 57/282; 57/400

[58] Field of Search ..... 428/37, 92, 222, 428/369, 371, 397, 17; 425/382.2, 325, 66, 76, 72.2; 57/400, 282

[56] References Cited

U.S. PATENT DOCUMENTS

| | | | |
|---|---|---|---|
| 2,072,580 | 3/1937 | Correll | 138/78 |
| 2,335,190 | 11/1943 | Minich | 18/57 |
| 2,363,457 | 11/1944 | Alderfer | 28/26 |
| 2,664,374 | 12/1953 | Slayter et al. | 154/91 |
| 2,714,569 | 8/1955 | Prindle et al. | 428/397 |
| 3,126,699 | 3/1964 | Lefevre et al. | 57/160 |
| 3,332,828 | 7/1967 | Faria et al. . | |
| 3,565,742 | 7/1967 | Stephens et al. | 428/92 X |
| 3,600,491 | 8/1971 | Shimoda et al. | 425/382.2 X |
| 3,601,971 | 8/1971 | Waterhouse | 57/155 |
| 3,837,980 | 9/1974 | Nishimura et al. | 428/92 X |
| 3,940,522 | 2/1976 | Wessells . | |
| 4,061,804 | 12/1977 | McCulloch | 428/92 X |
| 4,254,181 | 3/1981 | Bromley et al. | 428/371 |
| 4,351,147 | 9/1982 | Blackmon et al. | 428/371 |
| 4,376,746 | 3/1983 | Ward et al. | 425/382.2 X |
| 4,523,427 | 6/1985 | Carr | 428/370 |
| 4,600,644 | 7/1986 | Bromley et al. | 428/399 |
| 4,605,580 | 8/1986 | Goolsby et al. | 428/92 |
| 4,617,218 | 10/1986 | Cadenhead, Sr. | 428/92 |
| 5,281,475 | 1/1994 | Hollenbaugh, Jr. et al. | 428/364 |

FOREIGN PATENT DOCUMENTS

| | | |
|---|---|---|
| 110115 | 10/1974 | Japan . |
| 119318 | 10/1978 | Japan . |
| 101905 | 8/1981 | Japan . |
| 193559 | 11/1982 | Japan . |
| 30404 | 6/1988 | Japan . |

*Primary Examiner*—George F. Lesmes
*Assistant Examiner*—Terrel Morris
*Attorney, Agent, or Firm*—Larson and Taylor

[57] ABSTRACT

An artificial turf with high water rentivity. A cut pile is formed over the surface of a backing structure by implanting a multiplicity of tufts. Each tuft comprises one or a plurality of pile yarns. Each of the pile yarns is composed of one flat filament or a plurality of bundled flat filaments twisted and fixed in the twisted state into a slender form having an approximately spiral cross section. A pile yarn for such artificial turfs and a process for producing such a pile yarn.

3 Claims, 6 Drawing Sheets

ARTIFICIAL TURF, PILE YARN FOR ARTIFICIAL TURF AND PROCESS AND SPINNERET FOR PRODUCING PILE YARN

This application is a continuation of application Ser. No. 07/651,259 filed as PCT/JP90/00756, Jun. 8, 1990 now abandoned.

FIELD OF INDUSTRIAL APPLICATION

The present invention relates to artificial turfs having a cut pile comprising a multiplicity of tufts of pile yarn and formed over the surface of a backing structure, pile yarns for the artificial turf, and a process for producing such pile yarns.

The invention further relates to a spinneret for spinning flat filaments for producing the pile yarn.

PRIOR ART AND PROBLEM THEREOF

Various artificial turfs have been proposed for use which comprise a multiplicity of tufts formed by implanting grasslike yarns in a backing structure. Artificial turfs comprising a cut pile formed by implanting flat grasslike yarns in a backing structure are in wide use in recent years for providing grounds or courts for sports such as baseball, soccer, rugby or tennis. Also in use in recent years are artificial turfs which comprise a cut pile of relatively long tufts and sand placed into the spaces among the tufts with the tips of the tufts projecting from the surface of the sand layer. The ground or court formed by the artificial turf including the sand layer is free from streaks which tend to appear in the implanting direction of the tufts, appears like a natural turf and is therefore excellent.

However, on the ground, court or the like which is provided with any of the above artificial turfs, it is frequently likely that the player will suffer a frictional injury or get burnt with heat of friction, for example, when falling down into contact with the tips of tufts. To eliminate the likelihood, it has been the practice to diminish friction and heat of friction by spraying water on the artificial turf.

The artificial turf nevertheless has the problem that the pile is low in water retentivity, necessitating frequent application of water, so that it has been desired to overcome the problem.

An object of the present invention is to solve the above problem and to provide an artificial turf having high water retentivity, a pile yarn capable of giving high water retentivity for use in artificial turfs and a process for producing the pile yarn.

Another object of the invention is to provide a spinneret for forming filaments which are advantageous to the production of the pile yarn.

MEANS FOR SOLVING THE PROBLEM

The above object is accomplished by an artificial turf which is characterized in that a cut pile is formed over the surface of a backing structure by implanting in the backing structure a multiplicity of tufts each comprising one or a plurality of pile yarns, each of the pile yarns being composed of one flat filament or a plurality of bundled flat filaments, each filament being wound and fixed in a wound state into a slender form having an approximately spiral cross section.

The above object of the invention is fulfilled also by a pile yarn for artificial turfs for use in forming a cut pile of a multiplicity of tufts over the surface of a backing structure, the pile yarn being characterized in that the yarn comprises one flat filament or a plurality of bundled flat filaments having been wound and, fixed in the wound state and thereby made to have a slender form of an approximately spiral cross section.

The above object of the invention is fulfilled also by a pile yarn for artificial turfs for use in forming a cut pile of a multiplicity of tufts over the surface of a backing structure, the pile yarn being characterized in that the pile yarn is composed of a plurality of yarns, each of the component yarns comprising one flat filament or a plurality of bundled flat filaments wound in one direction into a slender form of an approximately spiral cross section, the plurality of component yarns being twisted together in a direction opposite to said direction of winding.

The above object of the present invention is further achieved by a process for producing a pile yarn for artificial turfs characterized by twisting one flat filament or a plurality of bundled flat filaments to form wound filaments having an approximately spiral form in cross section and thereafter fixing the filament or filaments into a slender form having a spiral cross-section when viewed in a plane generally perpendicular to the axis, or by a process for producing a pile yarn for artificial turfs characterized by twisting one flat filament or a plurality of bundled flat filaments to form wound filaments having an approximately spiral cross section when viewed in a plane generally perpendicular to the axis and thereafter twisting together a plurality of lengths of the resulting yarn in a direction opposite to the direction of the winding.

The above object of the invention is further fulfilled by a spinneret for forming filament for artificial turfs characterized in that the spinneret has C-shaped or reversely C-shaped orifices each having an end portion extending approximately straight, or by a spinneret for forming filaments for artificial turfs characterized in that the spinneret has approximately S-shaped or reversely approximately S-shaped orifices.

Preferably, the flat filament to be used is 3 mm to 50 mm in width, 0.02 mm to 0.15 mm in thickness and 150 to 2500 in flatness ratio. The term "flatness ratio" as used herein means a value obtained by dividing the width of the filament by the thickness thereof. The flat filament may be prepared from a spun material corresponding to a plurality of such filaments continuously formed as arranged side by side, by cutting the material into individual filaments.

The filament to be used is any of a wide variety of those heretofore used for artificial turfs of the type described, such as those made of nylon resin, polypropylene resin, polyester resin, vinyl chloride resin, polyethylene or the like. Preferable are those made of polypropylene resin.

The present invention will be described in greater detail with reference to the following embodiments. However, the invention is not limited to these embodiments but can be modified variously within the scope of the appended claims.

EMBODIMENTS

Embodiments of the present invention will be described below with reference to the accompanying drawings.

Figure 1:
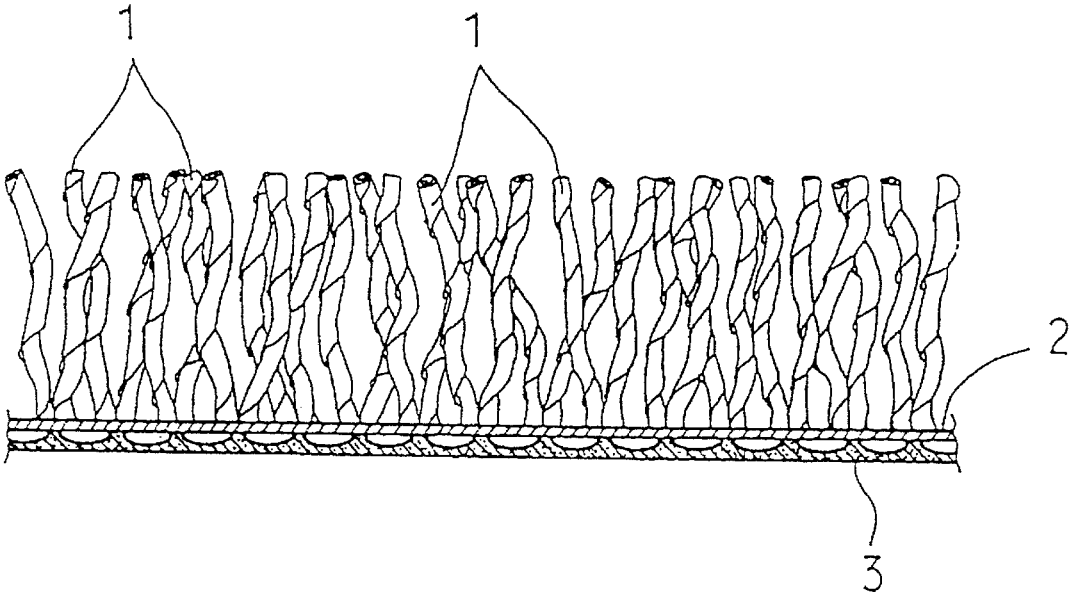
FIG. 1 is a side elevation in vertical section showing an artificial turf as a first embodiment of the invention.
Figure 2:
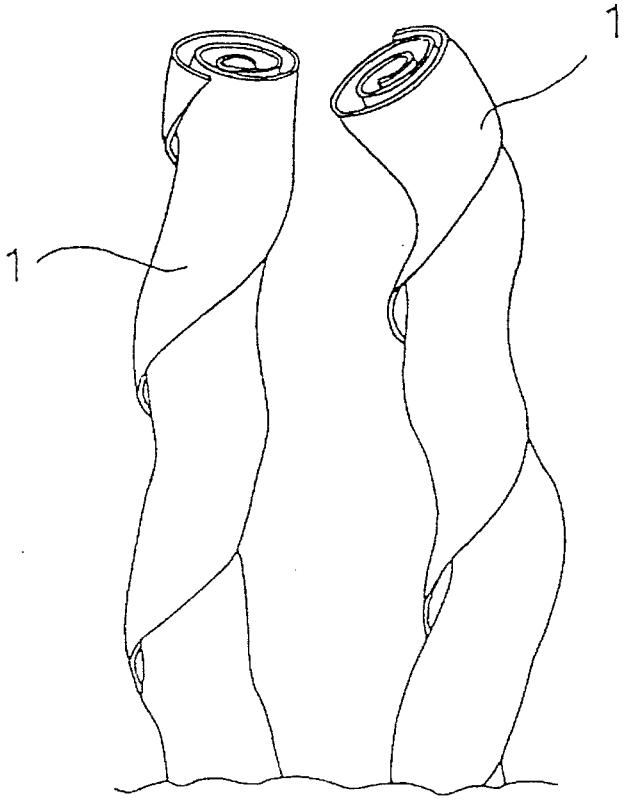
FIG. 2 is a perspective view showing the tips of cut pile tufts thereof on an enlarged scale.

FIG. 1 shows an artificial turf according to one of the embodiments of the invention. The artificial turf comprises a multiplicity of cut pile tufts 1 formed of a pile yarn and implanted in the surface of a backing structure 2. The rear surface of the backing structure 2 is formed with a resin layer 3 for backing to prevent the tufts from slipping off. As seen in FIG. 2, the cut pile tufts 1 are slender and single-twisted (Z-twisted according to the present embodiment) into a wound form which is spiral in cross section. The pile yarn forming the cut pile tufts 1 has been crimped, whereby the turf is given flexibility and made to feel comfortable to walk on. Of course, the cut pile tufts 1 may be S-twisted into a wound form.

The artificial turf of the invention thus constructed is used, for example, for forming the above-mentioned ground, court or the like. Sand is applied to the cut pile with the tips of the tufts 1 projecting from the surface of the sand layer. Since the cut pile tufts 1 are twisted into a wound which is spiral in cross section as already described, slender voids are formed in the interior of the tufts, and the water penetrating into the voids is held therein owing to the surface tension. Accordingly, the artificial turf of the present invention has the advantage of assuring the player of safety for a long period of time without the necessity of frequently sprinkling the turf with water to reduce friction and heat of friction.

To form the cut pile of tufts 1 which are spiral in cross section, it is desirable to use filaments which are 3 mm to 50 mm in width, 0.02 mm to 0.15 mm in thickness and 150 to 2500 in flatness ratio, preferably 5 mm to 30 mm in width and 0.04 to 0.10 mm in thickness. If the width is less than 3 mm, the cut pile tufts are too small in diameter, failing to exhibit satisfactory water retentivity mentioned, whereas if the width is larger than 50 mm, the tufts become excessively large in diameter and less likely to appear like a natural turf. Further if the flat filaments are smaller than 0.02 mm in thickness, the tufts are prone to abrasion or damage due to contact with the player when the turf is used, for example, for a ground, court or the like, hence poor abrasion resistance. When the thickness exceeds 0.15 mm, the flat filaments become excessively rigid, presenting difficulty in forming tufts which are wound from having a spiral cross section, hence a drawback.

Figure 3:
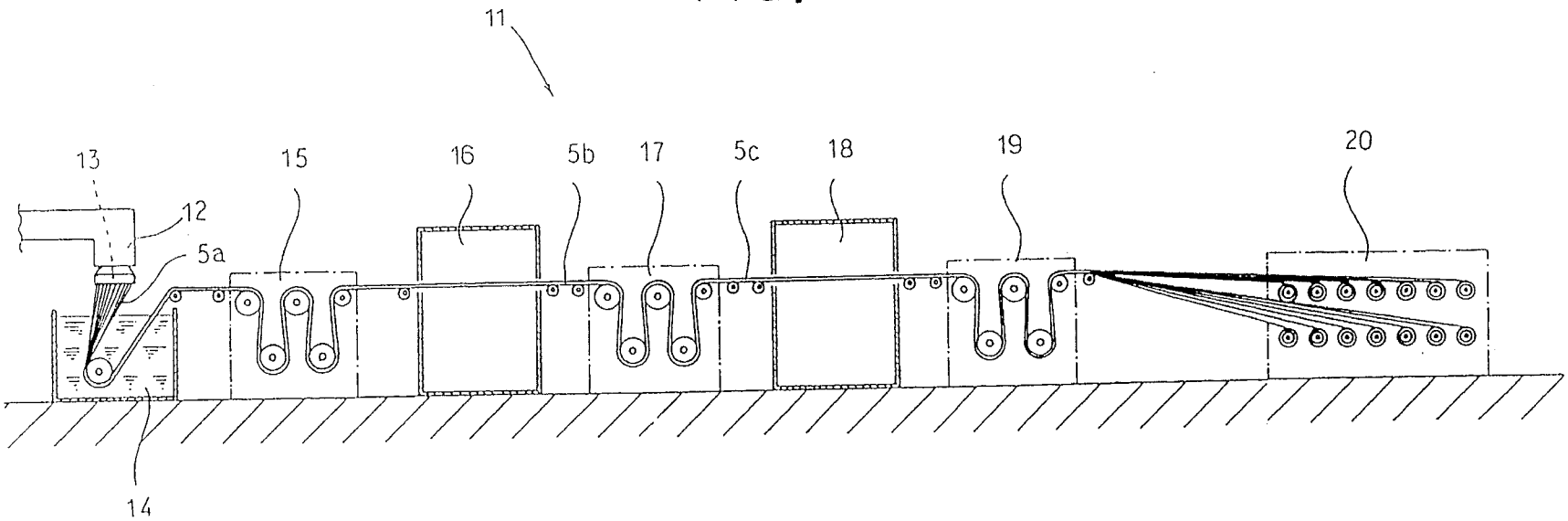
FIG. 3 is a side elevation schematically showing an example of apparatus for preparing flat pile yarns for producing pile yarns for artificial turfs of the invention.

FIG. 3 schematically shows an apparatus 11 for producing such flat filaments. The production apparatus 11, which is adapted to prepare a multiplicity of flat filaments, comprises a die 12 facing downward and attached to an extruder (not shown) for extruding a molten resin, and a spinneret 13 attached to the die 12 for spinning flat filaments. The flat extrudates **5*a* discharged from the orifices of the spinneret 13 are passed through a cooling water bath 14 disposed immediately below the spinneret 13 and then sent into a heating tank 16 by way of first snap rolls 15. The filaments 5*b* heated in the tank 16 are sent forward over second snap rolls 17. The flat extrudates are drawn, for example, to five times the original length by these first snap rolls 15, heating tank 16 and second snap rolls 17. The flat filaments 5*c* subjected to the drawing step are passed through a heat treatment tank 18 and transported over third snap rolls 19. The residual strain resulting from the drawing step can be removed from the filaments 5*c* by passing the filaments 5*c* through the heat treatment tank 18. The flat filaments 5*c* forwarded by the third snap rolls 19 are individually wound up by a take-up device 20** as a material and fed to a single twisting step of an artificial turf production apparatus (not shown) during which the filaments are twisted to form wound filaments.

The snap rolls 15, 17 and 19 installed in the flat filament production apparatus 11 can be replaced by clover rolls, godet rolls, or the like.

Figure 4:
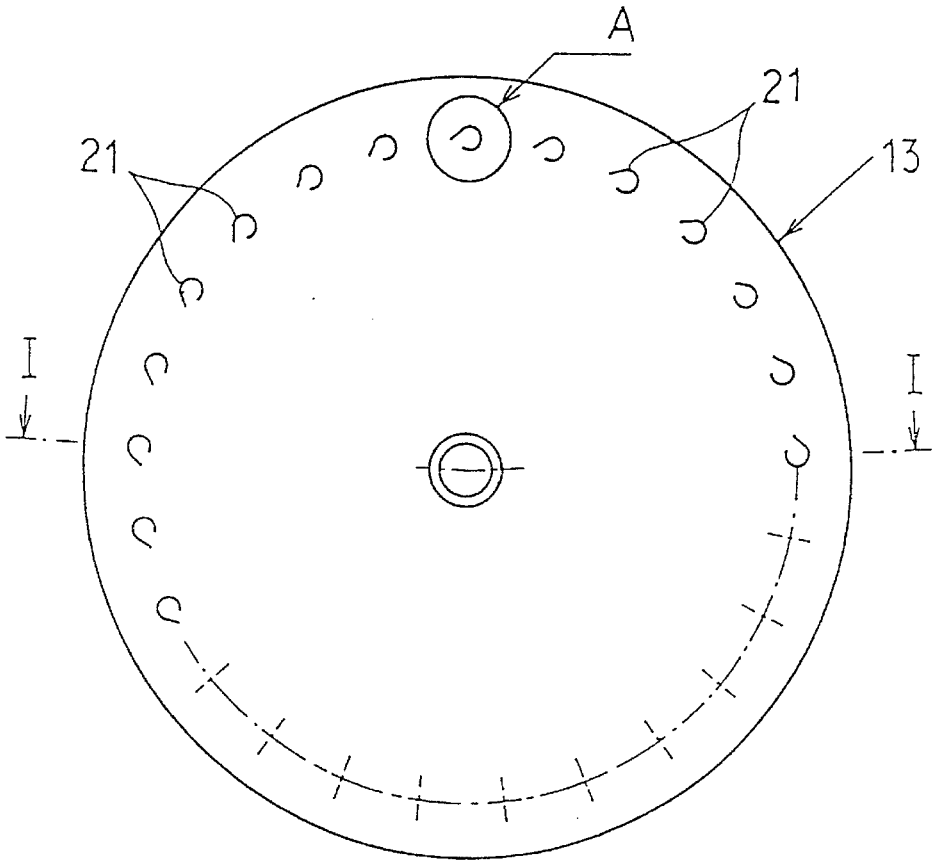
FIG. 4 is a plan view showing an embodiment of spinneret of the invention.
Figure 5:
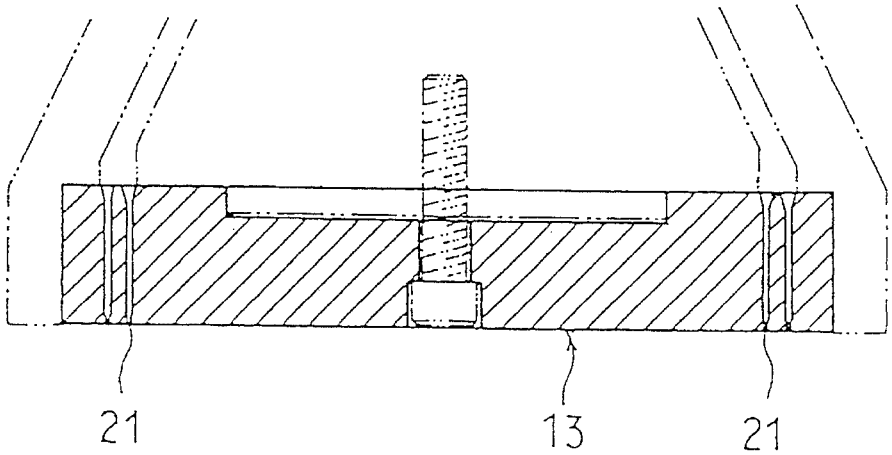
FIG. 5 is a view in section taken along the line I—I in FIG. 4.
Figure 6:
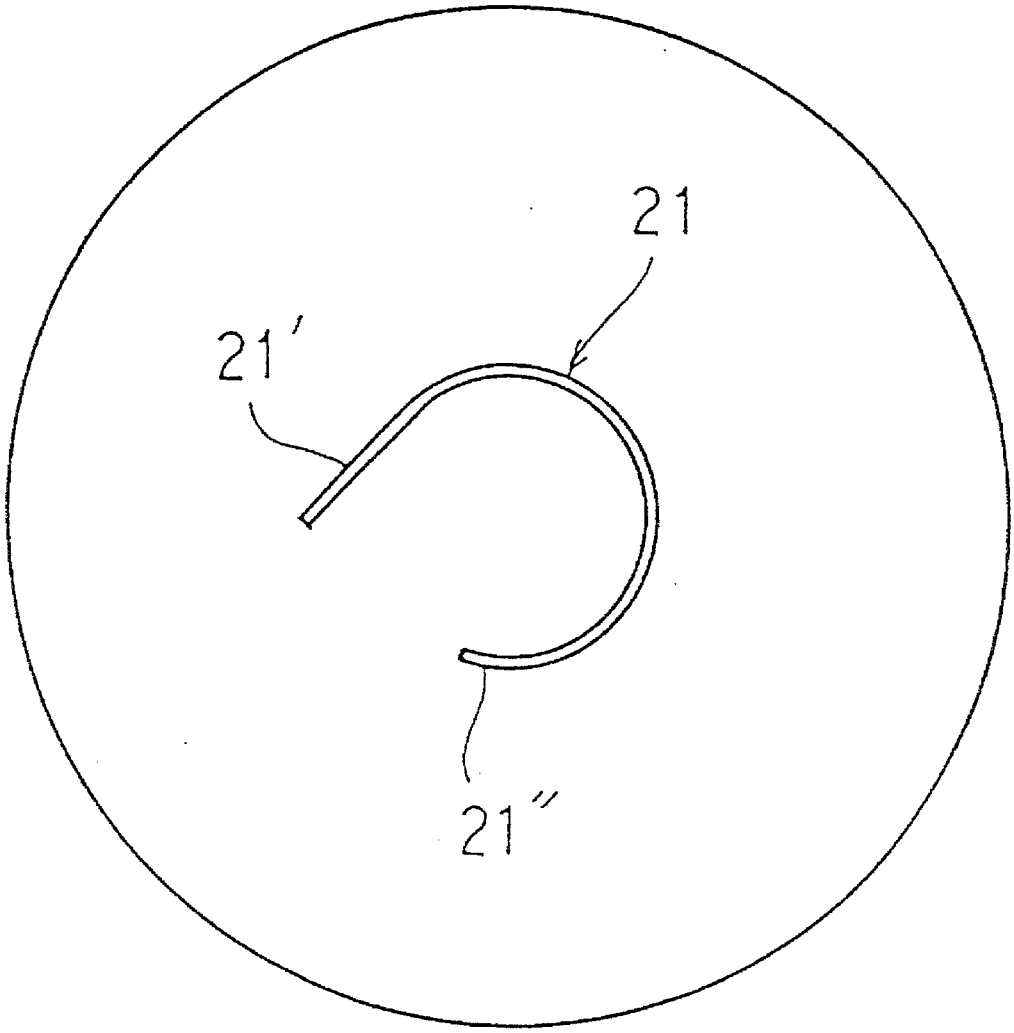
FIG. 6 is an enlarged view showing the portion A in FIG. 4.
Figure 7:
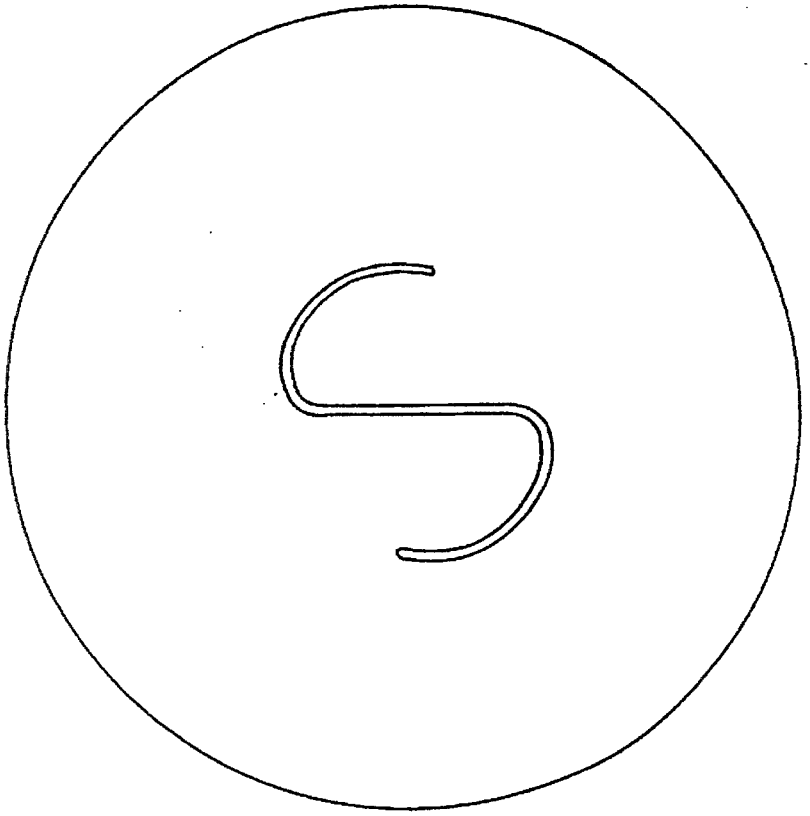
FIG. 7 is an enlarged view of another example of portion A.

As seen in FIGS. 4, 5 and 6, the orifices 21 formed in the spinneret 13 are C-shaped and have one end 21' extending approximately straight. Accordingly, the flat extrudates from the orifices 21 of the spinneret 13 have a cross section which is similar to that of the orifices 21 in configuration. The flat filaments thus formed have the advantage that they can be readily made spiral in cross section when single-twisted to a wound form (Z-twisted in the present embodiment), consequently facilitating the production of pile yarns of the present invention. Alternatively, the orifices 21 can be so shaped that the other end 21" of the C-configuration extends approximately straight. When the flat filament formed by the orifice is S-twisted in this case, a pile yarn can be readily obtained which has a spiral cross section. It is desirable to soft-twist the flat filament when the width thereof is large or to hard-twist the filament if the width is small. Examples of devices for single-twisting the flat filament into a wound form are a ring twister, doubling and twisting machine, double twister, etc. The devices to be used for fixing the wound state are, for example, a vacuum-type steam setter and the like. The filament which is C-shaped in cross section may alternatively have a cross section which is reversely C-shaped, S-shaped as seen in FIG. 7, reversely S-shaped, or straight as usual. Such a filament is single-twisted into a wound form and thereby made spiral in cross section.

The pile yarn subjected to the single twisting step is then crimped as by knitting and deknitting when so required, fixed in the crimped state and wound up again. The pile yarn is implanted in a backing structure to form on the surface of the backing structure a multiplicity of cut pile tufts which are spiral in cross section.

The cut pile is then subjected to a backing treatment for preventing the tufts from slipping off the backing structure. The backing treatment is carried out in a usual manner, for example, by fixing the pile yarn tufts to the rear side of the backing structure with a resin and further adhering a sheet to the resin layer.

Figure 9:
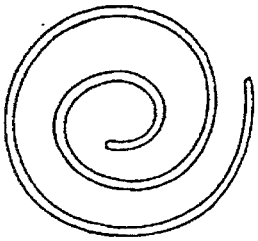
FIG. 9 includes cross sectional views showing examples of pile yarns embodying the invention.
Figure 9:
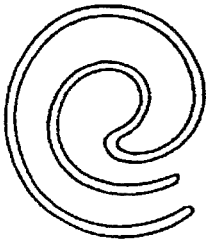
Figure 9:
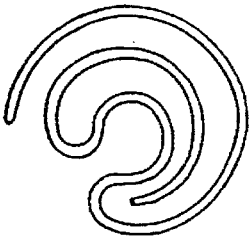
Figure 8:
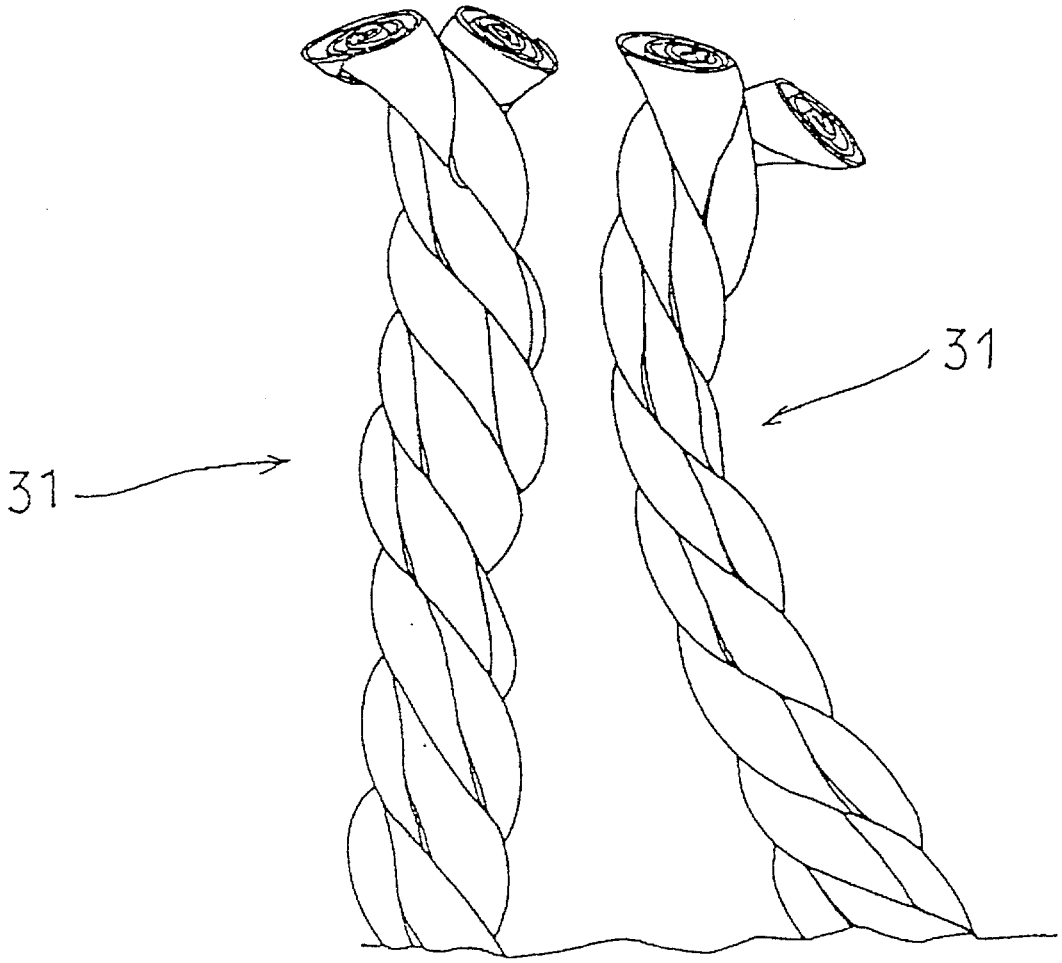
FIG. 8 is a perspective view showing on an enlarged scale the tips of cut pile tufts of an artificial turf as another embodiment of the invention.

A plurality of, e.g. two, filaments of spiral cross section subjected to the single twisting step may be subjected further to a double twisting step to form a single pile yarn, which may be implanted in a backing structure. FIG. 8 shows the pile yarn 31 thus formed. A single pile yarn may be formed by single-twisting a plurality of bundled filaments to a wound form which has a spiral cross section and fixing the filaments in the wound state. Further a single pile yarn may be formed by twisting a plurality of bundled filaments into a wound single yarn of spiral cross section, bundling the plurality of lengths of the resulting yarn, and twisting the bundle in a direction opposite to the direction of winding. The spiral cross section can be of various configurations as illustrated in FIG. 9. FIG. 9, (a) shows a flat filament wound as it is, (b) shows a flat filament wound as folded in two, and (c) shows a flat filament wound as folded in three, these filaments being shown in cross section.

The cut pile tufts formed by such pile yarns have water-retaining voids in the interior like those of the foregoing artificial turfs, and water can be retained also between the filaments or between the yarns of spiral cross section. Thus, the tufts have high water retentivity.

Furthermore, a plurality of such pile yarns may be provided as bundled to form each tuft.

For the double twisting step, known double twisting machines which are generally used can be employed besides the twisting machines already mentioned.

ADVANTAGES OF THE INVENTION

As will be apparent from the foregoing description, the artificial turf of the present invention has cut pile tufts each comprising a pile yarn twisted to a wound form having an approximately spiral wound cross section and therefore has high water retentivity. This assures the player or athlete of safety over a long period of time without the necessity of frequently sprinkling water on the turf.

The present invention further provides pile yarns twisted to a generally spiral form in cross section and advantageous to the production of artificial turfs having good water retentivity, and also provides a process for preparing such pile yarns.

The spinneret of the present invention is formed with C-shaped or reversely C-shaped orifices having one end extending outward approximately straight, or with S-shaped or reversely S-shaped orifices, so that filaments can be obtained which have the same cross sectional configuration as the orifices. This facilitates production of pile yarns generally spiral in cross section for use in articial turfs.

I claim:

1. An artificial turf having improved water retentivity including a cut pile which is formed over the surface of a backing structure by implanting in the backing structure a multiplicity of tufts, each of which comprises at least one pile yarn having a longitudinal axis, each pile yarn comprising one filament or a plurality of bundled filaments, the one or plurality of filaments having one of a C-shaped, reverse C-shaped, S-shaped or reverse S-shaped cross section and being spirally wound, the wound filaments being fixed into a slender form having a spiral cross section when viewed in a plane generally perpendicular to the axis, the pile yarn having an interior void extending along the axis of the pile yarn.

2. An artificial turf according to claim 1 wherein each of the filaments has a flatness ratio of 150 to 2500.

3. An artificial turf according to claim 1 wherein the width of each of the filaments is from 3 mm to 50 mm and the thickness of each of the filaments ranges from 0.02 mm to 0.15 mm.

* * * * *